United States Patent [19]

Richter et al.

[11] 4,313,055

[45] Jan. 26, 1982

[54] AUTOMATIC EXPOSURE CONTROL DEVICE FOR AN X-RAY GENERATOR

[75] Inventors: Detlev Richter, Norderstedt; Robert Zimmermann, Hamburg, both of Fed. Rep. of Germany

[73] Assignee: U.S. Philips Corporation, New York, N.Y.

[21] Appl. No.: 47,559

[22] Filed: Jun. 8, 1979

[30] Foreign Application Priority Data

Jun. 9, 1978 [DE] Fed. Rep. of Germany ..... 2825323

[51] Int. Cl.[3] ..... H05G 1/42

[52] U.S. Cl. ..... 250/322; 250/421

[58] Field of Search ..... 250/322, 421

[56] References Cited

U.S. PATENT DOCUMENTS 3,911,273 10/1975 Franke ..... 250/322

3,986,033 10/1976 Mester et al. ..... 250/421

FOREIGN PATENT DOCUMENTS 978152 12/1964 United Kingdom ..... 250/421

*Primary Examiner*—Alfred E. Smith

*Assistant Examiner*—T. N. Grigsby

*Attorney, Agent, or Firm*—Jack E. Haken

[57] ABSTRACT

The automatic exposure control devices of contemporary X-ray generators have a constant lead time which accurately takes into account the actual ratios or delays only for a given setting of current and voltage. Particularly in the case of high voltages and small currents, the lead times are too short, thus giving rise to overexposures. The invention provides an automatic exposure control device in which the lead time is calculated from the exposure data by an arithmetic unit. The lead time is adjusted on a correspondingly constructed adjustable lead time network. An arithmetic unit of this kind is not required for the programmed exposure technique. The correct lead times can then be programmed and stored together with the other exposure parameters.

8 Claims, 7 Drawing Figures

AUTOMATIC EXPOSURE CONTROL DEVICE FOR AN X-RAY GENERATOR

Figure 1A:
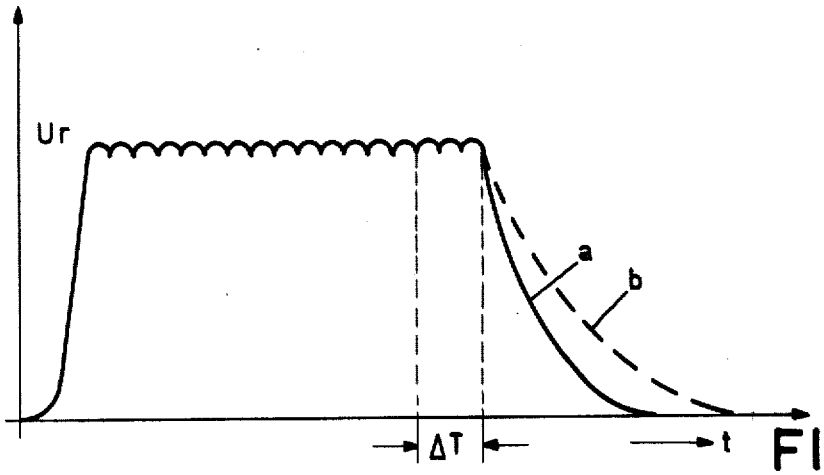

The invention relates to an automatic exposure control device for an X-ray generator which comprises a switch, included in the primary circuit of a high voltage transformer thereof, for switching off the voltage applied to an X-ray tube, a measuring member for measuring the dose, a comparison device for comparing a first signal which corresponds to the measured dose with a reference signal and for controlling the switch, and a switch-off circuit for generating a switch-off command for the switch before the desired dose is reached.

The switch-off circuit serves to prevent incorrect exposures which would occur if the switch-off command were given only after the reaching of the adjusted dose. Due to the unavoidable delay times of the X-ray generator, inter alia caused by the delay of the actuation of the switch when the voltage applied to the X-ray tube is switched off and by the afterflow of the image pick-up device (intensifier foils or image intensifiers), the exposure continues after the switch-off command has been given. Therefore, the switch-off command must be biven in time before the adjusted dose is reached, so that the exposure carried out thus far and the further exposure resulting from the delay together produce the required density. The period of time expiring between the instant at which the switch-off command is given and the instant at which the adjusted dose is reached, said period of time being referred to hereinafter as the lead time, corresponds to a constant delay time of the X-ray generator.

In a known automatic exposure control device of the kind described (German Offenlegungsschrift No. 21 54 539), however, incorrect exposures still occur in spite of the presence of such a switch-off circuit, notably in the case of exposures utilizing high tube voltages and small tube currents during very short exposure times.

Therefore, the invention has for its object to provide an automatic exposure control device of the kind described in which the occurrence of the described incorrect exposures is mitigated to a very high degree.

This object in accordance with the invention is realized in that the switch-off circuit is designed for different lead times, one of which is each time adjustable in dependence of the exposure data (kV and mA).

The invention is based on the fact that in an X-ray generator in which the primary circuit of the high voltage transformer includes a switch for switching off the voltage applied to the X-ray tube, the voltage in the secondary circuit, i.e. the voltage on the X-ray tube, is not switched off at the same instant as the voltage in the primary circuit.

The variation in time of the voltage on the X-ray tube and of the position in the time of the switch-off command with respect to the variation of the tube voltage is as follows. The voltage on the X-ray tube increases to the adjusted value at the start of an X-ray exposure. This voltage remains at the adjusted value when the switch-off command is given, because the switch in the primary circuit of the high voltage transformer will not switch-off immediately, so that the primary voltage is still present. The voltage on the X-ray tube decreases only after the switching off of the voltage on the primary circuit of the high voltage transformer after expiration of the delay time $\Delta T$ of the switch. However, the voltage on the X-ray tube cannot decrease in a transient-like manner, because in the secondary circuit energy is stored in capacitances of the cable and possibly of the high voltage rectifier, said energy still being converted into radiation (and heat) in the X-ray tube. Thus, after the switching off of the primary voltage of the high voltage transformer, a substantially exponential decrease of the voltage across the X-ray tube occurs. This decrease is dependent of the adjusted value of the voltage on the X-ray tube as well as of the adjusted current flowing through the tube. In the case of a smaller tube current, a slower decrease of the tube voltage occurs. The slow decrease of the tube voltage is due to the fact that the discharging of the capacitances in the secondary circuit is slower when the tube current is smaller.

Thus, for a delay time $t_v$, the following equation is approximately valid:

$$t_v = t_0 + kC\, U_r/I_r \qquad (1)$$

Therein, $t_0$ is the constant delay time caused by the delay of the switch in the primary circuit and by the afterglow duration of the pick-up device (intensifier foil or image intensifier), $I_r$ is the current through the X-ray tube, $U_r$ is the tube voltage, and C is the capacitance of the high voltage cables and possibly of the high voltage generator if the latter includes filter capacitors. k is a constant factor to take into account that the tube voltage, and hence also the dose, decreases after the switching off of the primary voltage. This factor, which may be emperically determined, is always smaller than 1.

In practice, the operator will not have the opportunity or will not be willing to calculate and adjust the lead time in accordance with the equation (1). Adjustment of the lead time by service-operator, therefore, is applicable only for the programmed exposure technique where the lead time, together with other exposure parameters (for example, tube voltage, tube current, density etc.), is adjusted once by said operator, usually a technician, for an organ, for example, a stomach, after which these values are stored; the exposure parameters, i.e. including the lead time, can then be fetched again by operation of a correspondingly denoted button.

A further embodiment in accordance with the invention which can also be used for exposure parameters adjusted at random (i.e. by the radiologist for one X-ray exposure) and which does not burden the operator, is characterized in that the switch-off circuit is controlled by an arithmetic unit which calculates the lead time from the given delay times of the X-ray generator and the image pick-up system and from the adjusted values of tube current and tube voltage, said lead time being applied to the switch-off circuit.

In the automatic exposure control device in accordance with the invention, the arithmetic unit calculates the required lead time, for example, in accordance with equation (1) and controls the switch-off circuit so that the calculated lead time is formed. The detailed control of the switch-off circuit is dependent of the construction of the arithmetic device.

A further embodiment in accordance with the invention, utilizing an automatic exposure device in which the comparison device compares a signal corresponding to the adjusted dose with the first signal and in which the difference between these two signals is reduced by a correction signal supplied by the switch-off circuit, said signal being proportional to the product of the lead time and the differential quotient of the first signal, is characterized in that the switch-off circuit is controlled by the arithmetic unit so that the correction signal is changed in proportion to the calculated lead time.

Use is thus made of the fact that the dose behind the object, or the first signal, increases regularly in the ease of a constant tube power, i.e. it increases linearly in the time. In order to obtain the switch-off command before the first signal reaches a voltage value corresponding to the adjusted dose, a value which is mainly constant and which corresponds to the differential quotient of the first signal is added to the first signal. The lead time thus formed is constant and independent of the rate of the linear increase.

In accordance with a further embodiment of a control device according to the invention, the arithmetic unit calculates the required lead time and controls the switch-off circuit so that the correction signal is proportional to the gradient of the first signal and to the calculated lead time, (i.e. proportional to the product of the lead time and the increase of the first signal). This could in principle be realized in that the arithmetic unit calculates the correction signal from the calculated lead time and adds this correction signal to the first signal via a digital-to-analog converter. For example, if the correction signal is increased, a proportionally longer lead time is formed.

A further embodiment in accordance with the invention is characterized in that the switch-off circuit comprises a function generator which is actuated by the starting of the exposure and which generates a signal which varies hyperbolically as a function of the time, which is asymptotically built up to a value corresponding to the adjusted dose and which is compared in the comparison device with the dose-proportional signal, the arithmetic unit controlling the function generator so that for a longer lead time a slower formation of the hyperbolic signal occurs.

The invention will be described in detail hereafter with reference to the accompanying diagrammatic drawing.

Figure 1B:
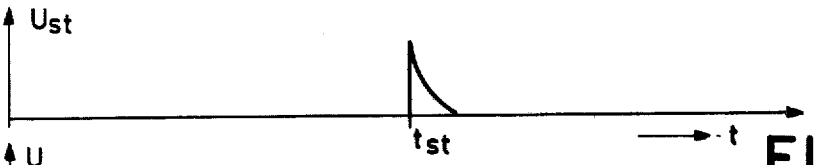
Figure 2:
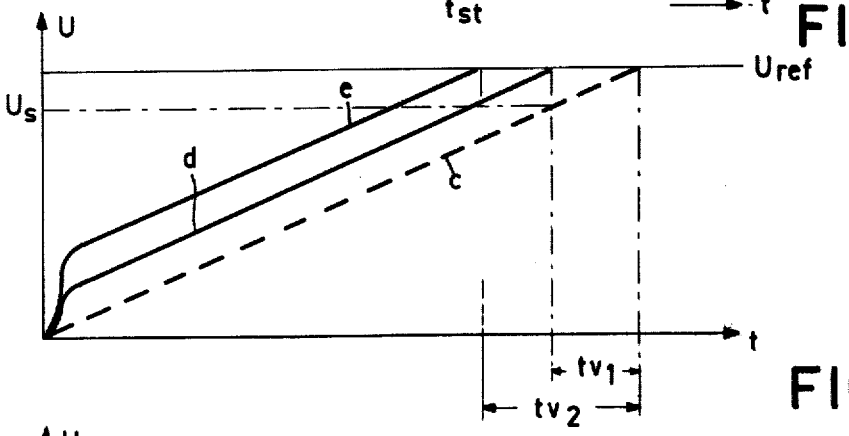
Figure 3:
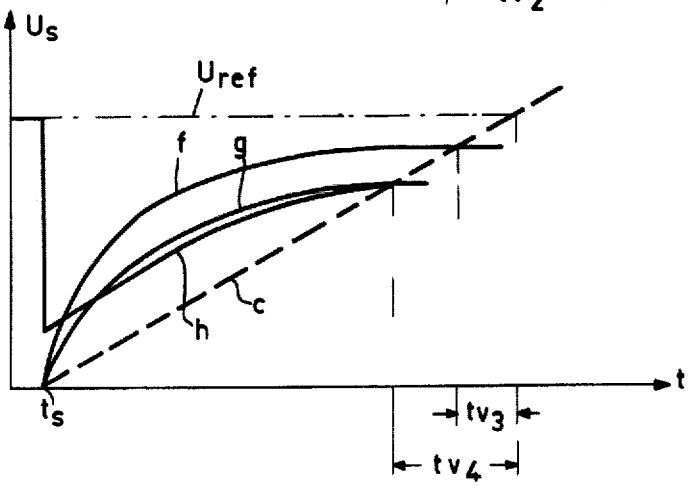
Figure 4:
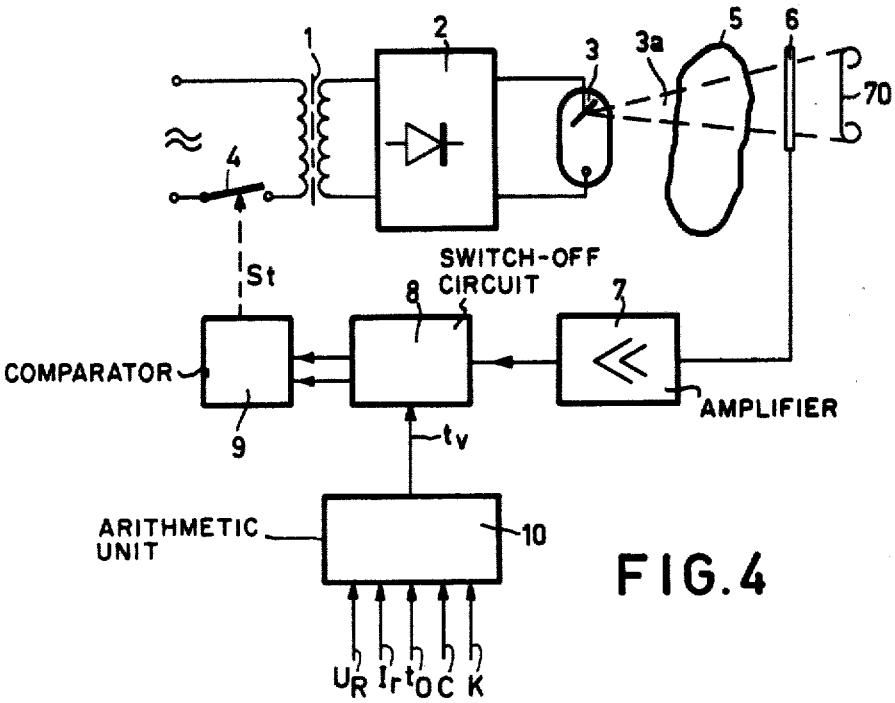
Figure 5:
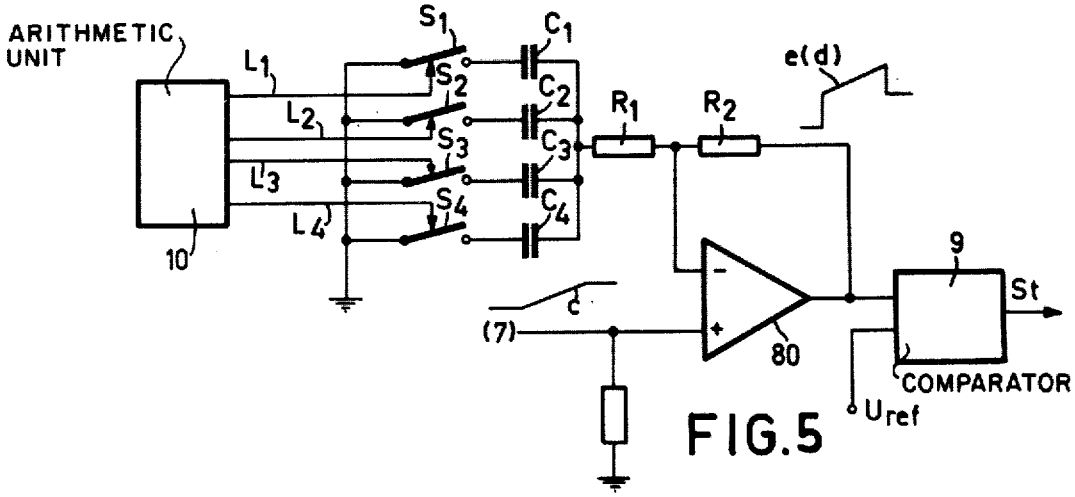
Figure 6:
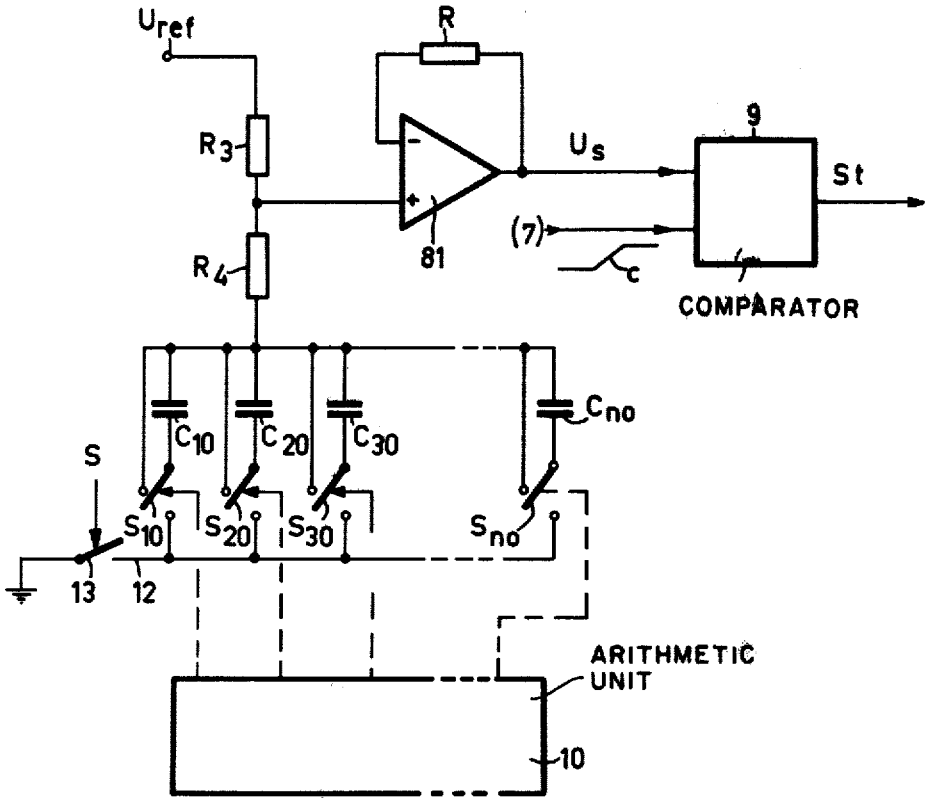

FIGS 1*a* and 1*b* show the variation in the time of the tube voltage during an X-ray exposure using a known X-ray generator, FIG. 2 shows the variation in time of the first signal and of the reference signal in an embodiment of an automatic exposure control device in accordance with the invention, FIG. 3 shows the variation in the time of the reference signal and of the first signal in a further embodiment of an automatic exposure control device in accordance with the invention, FIG. 4 shows the block diagram of an X-ray generator comprising an automatic exposure control device in accordance with the invention, FIG. 5 shows an embodiment of a switch-off circuit of an automatic exposure control device in accordance with the invention, and FIG. 6 shows a further embodiment of a switch-off circuit of an automatic exposure control device in accordance with the invention, FIGS. 1*a* and 1*b* show the variation in the time of the voltage $U_r$ on an X-ray tube and the position of the switch-off command with respect to the variation of the tube voltage $U_r$. After the switching on of the X-ray tube, the voltage increases to an adjusted value. If the switch-off command $U_{st}$ is given at the instant $t_{st}$, the voltage $U_r$ remains at the adjusted value due to the inertia of the switches in the primary circuit of the high voltage generator. The switches in the primary circuit are opened only after a delay time $\Delta T$, after which the voltage across the X-ray tube decreases. However, this voltage cannot decrease in a gradient-like manner, because energy is stored in the secondary circuit in the capacitances of the high voltage cables and possibly of the high voltage rectifier, said energy being converted into radiation (and heat) in the X-ray tube after the switching off of the switches in the primary circuit. After expiration of $\Delta T$, the voltage across the X-ray tube will decrease substantially exponentially and will follow, for example, curve a. The rate of decrease of the voltage across the X-ray tube is dependent of the adjusted X-ray tube current. If the voltage decreases according to curve a for a given X-ray tube current setting, the voltage will decrease, for example, according to curve b for a lower tube current setting.

FIG. 2 shows the variation of a first signal c, being proportional to the dose, and of the reference signal $U_{ref}$ in an embodiment of an automatic exposure control device in accordance with the invention. In order to generate the switch-off command ($U_{st}$ at $t_{st}$ see FIG. 1*b*) before the first signal c becomes equal to the reference signal $U_{ref}$, a mainly constant value which corresponds to the differential quotient of the signal c is added to the signal c, with the result that the curve d is produced. The lead time $t_{v1}$ then occurring is constant and independent of the rate of the linear increase.

In accordance with the invention, an arithmetic unit (yet to be described) calculates the lead time associated with the setting of an X-ray tube so that the calculated lead time $t_{v2}$ is obtained by comparison of the sum of a correction signal and the first signal c with the signal $U_{ref}$. The correction signal is proportional to the gradient of the first signal and proportional to the calculated lead time. The sum of the first signal c and the correction signal is the curve e.

A further solution is based on the consideration that the same effect is obtained when the correction signal, corresponding to the product of the lead time and the increase of the signal corresponding to the dose, is not added to the first signal c but is subtracted from the reference signal $U_{ref}$ which corresponds to the adjusted dose. Thus, the same result is achieved as by the increasing of the signal c to the curve d if the comparison device is allowed to supply the switch-off command when the first signal (curve c) reaches the value $U_s$ which corresponds to a dose which is smaller than the adjusted dose. If the increase of the first signal c which is proportional to the dose is larger than shown in FIG. 2 (corresponding to a shorter exposure duration), the correction signal is larger, because the signal is proportional to the increase or the differential quotient in the time of the first signal which is proportional to the dose. This means that the voltage $U_s$ with which the first signal corresponds to the dose is compared is then lower. Thus, the following relation exists between the value $U_s$ and the lead time $t_v$ $$U_s = U_{ref}(1 - t_v/(t + t_v)) \quad (2)$$

in which $t_v$ is the lead time and $U_{ref}$ is the voltage value corresponding to the adjusted dose. FIG. 3 shows the variation in the time of the reference signal $U_s$ as a function of the time t for two different lead times $t_{v3}$ and $t_{v4}$, the curve f being formed for the shorter lead time $t_{v3}$ and the curve g for the longer lead time $t_{v4}$.

According to this solution, the first signal (curve c) which is proportional to the dose is not compared with a constant reference value $U_{ref}$ in the comparison device, but rather with a hyperbolic reference signal $U_s$ which varies in the time and which commences at the start of exposure (instant $t_s$) and asymptotically tends to equal the value $U_{ref}$ which each time corresponds to the adjusted dose.

Both possibilities described with reference to the FIGS. 2 and 3 can be utilized for automatic exposure control devices with analog measuring value processing as well as in similar devices with digital measuring value processing (known from German Offenlegungsschrift No. 19 16 321). The digital solution according to FIG. 2 can be realized, for example, in that the pulses which succeed each other more or less densely in accordance with the dose power and which represent the dose are multiplied each time for a predetermined period of time (as described in German Offenlegungsschrift No. 19 16 321), the multiplication factor (being proportional to the lead time) being calculated by the arithmetic unit and being adjusted on the multiplier device. The solution described with reference to FIG. 3 can also be realized in a digital manner in that in the automatic exposure control device in accordance with German Offenlegungsschrift No. 19 16 321, in which a counter counts the pulses representing a given dose and terminates the X-ray exposure when a predetermined number of pulses is reached, this number of pulses is continuously increased in the time to be derived from FIG. 3 (curves g and f).

The X-ray generator shown in FIG. 4 comprises a high voltage generator, consisting of a high voltage transformer 1 and a rectifier 2, for the X-ray tube 3. Even through the drawing shows only one high voltage transformer for single-phase alternating current for the sake of simplicity, customary three-phase transformers are used. The primary circuit of the high voltage transformer 1 includes a switch 4, the closing of which starts an X-ray exposure, whilst the opening of this switch terminates the X-ray exposure after some delay. The X-radiation 3*a* emitted by the X-ray tube 3 passes through the body 5 of a patient to be examined as well as through a measuring member 6 for measuring the dose, for example, an ionisation chamber, and reaches an image pick-up device 70, for example, a film which is pressed against intensifier foils or an image intensifier whereto a film camera is coupled. The signal which is generated by the measuring device 6 and which is proportional to the dose is applied, via an amplifier 7, to a switch-off circuit 8 which controls a comparison device 9 which in its turn opens of closes the switch 4. The lead time $t_v$ presented to the switch-off circuit 8 is calculated by an arithmetic unit 10 which controls the switch-off circuit 8 accordingly.

The arithmetic unit 10 comprises, for example, an analog divider circuit, an analog multiplier circuit and some analog amplifiers. The arithmetic unit 10 can also consist entirely of conventional digital components, in which case analog/digital and digital/analog converters will be required.

The arithmetic unit 10 calculates the necessary lead time in accordance with the equation (1) from the values of the delay time $t_o$ of the capacitances C and of the factor k (which is constant for a given X-ray generator) as well as from the adjusted values of the current $I_R$ and the voltage $U_R$ aT the X-ray tube. The tube voltage $U_R$ and the tube current $I_R$ are fixed for each X-ray exposure, even if the operator adjusts only the tube voltage. Via suitable converters (not shown), these values are applied to the arithmetic unit 10. In X-ray generators in which the exposure data are introduced in a digital manner or are present in digital form while the arithmetic unit consists of digital components, converters of this kind are not required. The arithmetic unit 10 may also be a commercially available programmed small computer which is constructed, for example, by means of a microprocessor.

FIG. 5 shows an embodiment of a switch-off circuit which operates in accordance with the principle described with reference to FIG. 2. As has already been stated, it is necessary for the first signal c corresponds to the dose to be increased by an amount or for the reference voltage $U_{ref}$ to be decreased by an amount, said amount being proportional to the product of the lead time $t_v$ and the gradient of the first signal. To this end, the differential quotient of the first signal c, apparently corresponding to the gradient of this signal and being a constant in the case of a ramp-like increasing first signal, could be amplified by a factor which is proportional to the lead time. The lead time or the gain factor could then be calculated by the arithmetic unit 10 and be adjusted, for example, in that the resistance network determining the feedback in a high feedback amplifier is switched over in accordance with the calculated lead time. FIG. 5, however, shows a solution where the differentiated signal is modified in accordance with the calculated lead time by the switching over of the differential constant.

The circuit comprises an operational amplifier 80, the non-inverting input of which is connected to the amplifier 7 (FIG 4). The first signal c which corresponds to the dose is thus present on this input of amplifier. The inverting input is connected via a resistor $R_2$, to the output of the operational amplifier 80, so that it is fedback, and also, via the series connection of a resistor $R_1$ which is small in comparison with $R_2$, to a capacitor circuit. The output of the operational amplifier 80 supplies a signal which corresponds to the first signal, increased by a constant amount which corresponds to the product of the gradient of the first signal, the resistance value of $R_2$ and the capacitance of the capacitor circuit. In the embodiment shown, the capacitor circuit comprises four capacitors $C_1$-$C_4$, one connection of which is common to the resistor $R_1$ and the other connection of which is connected to ground, switches $S_1$-$S_4$. The switches $S_1$-$S_4$, may be suitable semiconductor components and are controlled by the arithmetic unit 10 via the lines $L_1$-$L_4$.

In principle a separate capacitor or a separate switch could be assigned to each lead time or to each lead time range. However, this would necessitate a very expensive control system. A particularly simple control system, however, is obtained by making the arithmetic unit 10 supply the calculated lead time in binary code, whilst on the four lines $L_1$-$L_4$ each time one of the four most significant binary positions of the binary coded calculated values is present. If furthermore the capacitances of the capacitors $C_1$-$C_4$ relate as $C_1$:$C_2$:$C_3$:$C_4$=8:4:2:1 and if the most significant binary position is present on the lines $L_1$, and the most significant binary position but one, the most significant binary position but two, and the most significant binary position but three is present on the lines $L_2$, $L_3$, $L_4$, respectively, the capacitance switched via the switch $S_1$-$S_4$ is directly proportional to the calculated lead time. Because the lead time produced when the output signal of the operational amplifier 80 is applied to the one input of the comparison device 9, the other input of which carries the constant reference value $U_{ref}$ (see FIG. 2), is proportional to the capacitance of the capacitor device switched by the switches $S_1$–$S_4$, the calculated lead time can thus be directly adjusted that the resistor $R_2$ is suitably proportioned. The lead time can then be changed in sixteen equal steps by means of four capacitors and four switches. In the device shown in FIG. 5, the constant delay due to the inertia of the switching elements and the afterglow of the image pick-up system can be taken into account by means of a suitably proportioned capacitor which is connected parallel to the capacitor device.

The switch-off circuit shown in FIG. 6 is based on the principle shown in FIG. 3 and comprises a function generator for generating a plurality of hyperbolic, more or less slowly increasing signals (for example, the signals f and g in FIG. 3), the arithmetic unit 10 calculating the lead time and switching on one of these signal paths. A hyperbolic curve which corresponds exactly to the equation (2) can be obtained only at comparatively great expense. Therefore, in the device shown in FIG. 6 use is made of the charging of a resistor-capacitor circuit which varies in known manner in accordance with an exponential function. Of course, instead of charging discharging could also be used.

The circuit comprises an operational amplifier 81, the inverting input of which is connected, via a resistor R, to the ouput thereof, which is thus strongly fedback, so that the output voltage corresponds substantially to the voltage on the non-inverting input. The non-inverting input is connected to the junction of the resistors $R_3$ and $R_4$, the resistor $R_3$ being approximately four times larger than the resistor $R_4$. The other connection of the resistor $R_4$ is connected to a capacitor circuit which comprises capacitors $C_{10}$–$C_{n0}$, one connection of which is each time connected to the resistor $R_4$, whilst the other connection is each time connected, via a switch $S_{10}$–$S_{n0}$, as desired to either the one common connection of all capacitors or to a line 12 which can be connected to ground via a switch 13. The voltage $U_{ref}$ which corresponds to the adjusted dose and which is each time constant for an exposure is present on the connection of the resistor $R_3$ which is remote from the junction of the resistors $R_3$ and $R_4$. The output signal of the operational amplifier 81 is compared with the first dose-proportional signal c in comparison device 9 and a switch-off command st is given as soon as the first signal c exceeds the reference signal $U_s$. The switches $S_{10}$–$S_{n0}$ are controlled by the arithmetic unit 10 so that the capacitor circuit has a low capacitance for short lead times and a high capacitance for long lead times.

The operation of the circuit shown in FIG. 6 is as follows:

At the start of the exposure, the switch 13 is closed by a start pulse S. As a result, the voltage on the non-inverting input of the operational amplifier 81, being equal to the voltage $U_{ref}$ corresponding to the adjusted dose prior to exposure, suddenly decreases to a value which amounts to approximately 20% of $U_{ref}$ and which is given by the voltage divider ratio of $R_3$ and $R_4$. During the further exposure, the capacitors each time connected to the line 12 via the associated switches $S_{10}$–$S_{n0}$ are charged according to an exponential function, the voltage on the non-inverting input of the operational amplifier 81 asymptotically increasing to the limit value $U_{ref}$. As soon as the dose-proportional first signal c on the one input of the comparison device 9 reaches the value of the reference signal $U_s$ thus obtained, the comparison device 9 supplies a switch-off command St which opens the switch 4 (FIG. 4).

The variation in the time of the signal $U_s$ for a predetermined time constant, is denoted by the reference h in FIG. 3. It will be seen that this voltage very well approximates the variation in the time of the hyperbolic curve g for slightly larger values of $U_s$. For the hyperbolic curve f, producing a smaller lead time, a smaller time constant must be used. It is again advisable to take into account the predetermined constant delay time of the X-ray generator by connecting a suitably proportional capacitor directly between the resistor $R_4$ and the line 12 (i.e. parallel to the capacitor circuit).

What is claimed is:

1. In an automatic exposure control device for an X-ray generator, comprising:

a primary circuit including a high voltage transformer for supplying preset values of voltage and current to an X-ray tube;

a switch, connected in the primary circuit, for switching off voltage to the X-ray tube;

measuring means, for measuring X-ray dose produced by the X-ray tube and for producing a signal corresponding thereto; and comparison means, for comparing the signal from the measuring means with a reference signal and for operating the switch in response thereto;

the improvement wherein the comparison means include switch-off means for generating a switch-off command which operates the switch before a desired dose is measured at a selected one of a number of different adjustable lead times, the lead time selected depending upon the values of the current and the voltage supplied to the X-ray tube.

2. The improvement of claim 1, further comprising an arithmetic unit, connected to the switch-off means, which calculates a lead time from known delay times produced by the X-ray generator and by an associated image pickup system and from the preset values of X-ray tube current and voltage.

3. The improvement of claim 2, wherein:

the switch-off means comprises a function generator which is activated at the start of an exposure and generates a time varying hyperbolic signal which is asymptotically built-up to a value which corresponds to the desired dose;

the comparison means is connected to compare said hyperbolic signal with the signal produced by the measuring means; and the arithmetic unit controls the function generator so that the formation of the hyperbolic signal occurs more slowly at longer lead times and more quickly at shorter lead times.

4. The improvement of claim 2, wherein the comparison means compare the measured dose with the desired dose and reduce the difference there-between with a correction signal which is supplied by the switch-off means and which is proportional to the differential quotient of the measured dose;

and the arithmetic unit controls the switch-off means so that the correction signal is changed in proportion to the calculated lead time.

5. The improvement of claim 2, wherein the switch-off means comprises:

an RC network which determines the lead time of the signal generated by the switch-off means and switching devices for switching time constants of the RC network in response to signals supplied by the arithmetic unit.

6. The improvement of claim 2, 4 or 5, wherein the switch-off means further comprise differentiating means including a resistor, a plurality of capacitors of different capacitance, and a plurality of switches for connecting combinations of the capacitors in parallel in response to control signals from the arithmetic unit.

7. The improvement of claim 6, wherein the arithmetic unit supplies binary coded control signals to the switch-off means, which signals are proportional to the lead time and wherein the values of the capacitors in the switch-off circuit which are connected by the signals from the arithmetic unit are related to each other by powers of two, whereby a time constant of the differentiating means is controlled in binary fashion.

8. The improvement of claim 3, wherein the function generator comprises a RC network which includes at least one resistor and a plurality of capacitors as well as a plurality of switches which are controlled by the arithmetic unit for switching the resistors and/or capacitors to control a time constant of the RC network.

* * * * *